US011141946B2

(12) United States Patent
Brisbin

(10) Patent No.: US 11,141,946 B2
(45) Date of Patent: Oct. 12, 2021

(54) BALING APPARATUS

(71) Applicant: Sebright Products, Inc., Hopkins, MI (US)

(72) Inventor: William Dale Brisbin, Hopkins, MI (US)

(73) Assignee: Sebright Products, Inc., Hopkins, MI (US)

( * ) Notice: Subject to any disclaimer, the term of this patent is extended or adjusted under 35 U.S.C. 154(b) by 246 days.

(21) Appl. No.: 16/053,401

(22) Filed: Aug. 2, 2018

(65) Prior Publication Data

US 2020/0039164 A1 Feb. 6, 2020

(51) Int. Cl.
*B30B 9/30* (2006.01)
*B65B 27/00* (2006.01)

(52) U.S. Cl.
CPC ..... *B30B 9/3003* (2013.01); *B65B 27/00* (2013.01)

(58) Field of Classification Search
CPC ..... B65B 13/04; B65B 13/06; B65B 13/08; B65B 13/10; B65B 13/16; B65B 13/18; B65B 27/12; B30B 9/30; B30B 9/3003; B30B 13/02; A01F 15/08; A01F 2015/143
See application file for complete search history.

(56) References Cited

U.S. PATENT DOCUMENTS 2,963,959 A * 12/1960 Van Doorn ..... B30B 9/3075 100/50
3,059,569 A * 10/1962 Nolt ..... A01F 15/042 100/98 R
3,827,350 A * 8/1974 Gilman ..... B30B 15/08 100/52
4,041,856 A * 8/1977 Fox ..... B30B 9/30 100/214
5,353,698 A * 10/1994 Robbins ..... B30B 9/3003 100/3
5,826,499 A * 10/1998 Bullington ..... B65B 27/12 100/3
2010/0071570 A1* 3/2010 Sagen ..... B65B 27/12 100/25
2013/0180416 A1* 7/2013 Stein ..... B65B 13/06 100/26
2018/0141298 A1* 5/2018 Hogervorst ..... A01F 15/042

FOREIGN PATENT DOCUMENTS

DE 3503546 A1 * 8/1986 ..... B30B 9/3003
DE 10213159 A1 * 10/2003 ..... B65B 27/12
FR 2429096 A1 * 1/1980 ..... B30B 9/301
FR 3029136 A1 * 6/2016 ..... B65B 13/24

* cited by examiner

*Primary Examiner* — Teresa M Ekiert
*Assistant Examiner* — Sarkis A Aktavoukian
(74) *Attorney, Agent, or Firm* — McGarry Bair

(57) ABSTRACT

The present disclosure relates to a baling apparatus that includes a baling chamber. The baling chamber is configure to receive material to be baled. Material to be baled can be compressed into the baling chamber. Adjacent to the baling chamber is a set of baling guides configured to guide baling ties. Each baling guide has an entrance and an exit, such that the baling tie enters and exits the baling guide some distance apart and at the same wall of the baling chamber.

20 Claims, 8 Drawing Sheets

BALING APPARATUS

BACKGROUND

Balers have been used for years by farmers to efficiently pack, handle, and transport straw and hay. An increase in demand to efficiently pack, handle, and transport materials other than straw and hay brought balers into the industrial arena. Balers in the industrial arena commonly incorporate a compactor. Balers typically compress and bind cardboard, plastic, aluminum, other recyclables, or other waste material.

Balers can have a hopper, which is an area for loading the material to be compressed. A compacting mechanism can then compress the material in a baling chamber. Alternatively, material to be baled can be loaded directly into the baling chamber. After compression, bale ties can be applied to compressed material manually. The bale tie can be tied using a clasp or a twist. Optionally, a ratchet or other mechanism is used to tighten the bale tie once applied. For larger volumes of compacted material, metal bale ties and guides for the bale ties are used. Conventionally, bale ties are inserted into a guide at the front or top of the baling chamber. A user then walks behind the baling chamber or accesses the top via a ladder or bridge to further guide the bale tie around the compacted material in the baling chamber.

BRIEF DESCRIPTION

In one aspect, the present disclosure relates to a baling apparatus. The baling apparatus includes a housing defining a baling chamber by at least one wall. The baling apparatus also includes a set of baling guides adjacent to the baling chamber, each baling guide configured to receive a bale tie. A ram is configured to compress material to be baled into the baling chamber. Each baling guide in the set has an entrance at the at least one wall and an exit spaced from the entrance at the at least one wall, so that a bale tie can be fed into the entrance with an entrance force and received at the exit by the entrance force for tying at the at least one wall.

Another aspect of the present disclosure relates to a method of baling material from at least one wall of a baler. The method can include compressing material to be baled into a baling chamber of the baler, guiding at least one baling tie into an entrance of a baling guide at the at least one wall using an entrance force, receiving the at least one baling tie from an exit spaced from the entrance at the least one wall by the entrance force, and tying the at least one baling tie at the at least one wall.

DESCRIPTION

Figure 1:
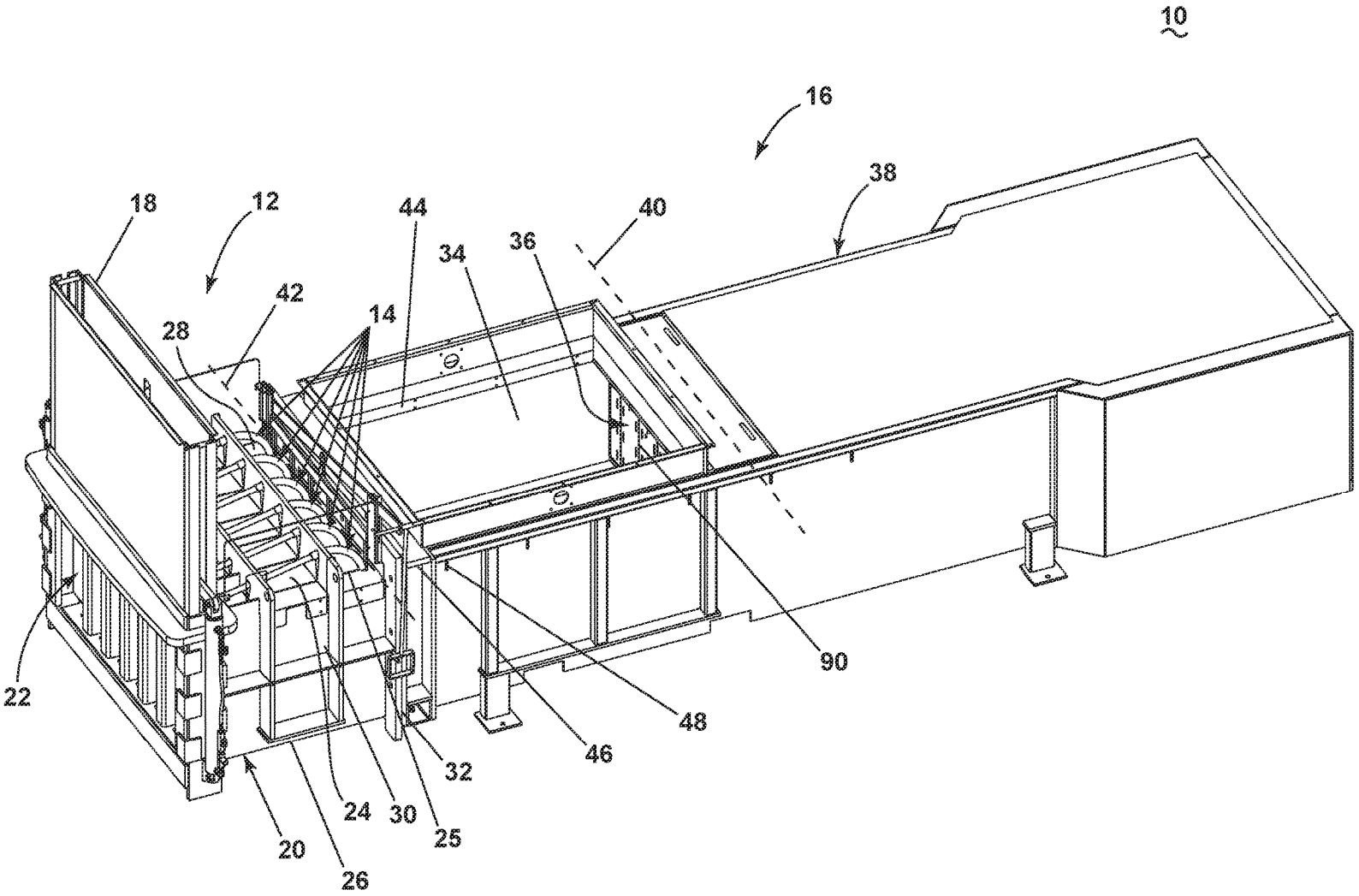
FIG. 1 is an isometric view of a baling apparatus according to aspects of the present disclosure.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, mounted, connected, fixed, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

As illustrated in FIG. 1, a baling apparatus 10 includes, at a minimum, a housing 12, a set of baling guides 14, and a ram 16. The housing 12 can include a baling chamber 20 having a movable front wall 22, a top wall 24, a bottom wall 26, opposing side walls 28, 30, and a back plane 32. The top wall 24 can include a top wire inlet 25. The top wire inlet 25 can be, by way of non-limiting example, in the shape of a slot that can allow a bale tie to pass through the top wall 24 into the baling chamber 20. The top wire inlet 25 is further discussed in the disclosure.

The front wall 22 is illustrated, by non-limiting example, as a gate-like structure. When the front wall 22, as illustrated in FIG. 1, is in a down or closed position, the front wall 22 defines a portion of the baling chamber 20. The front wall 22 can be lifted into an up or open position (not shown) and is received by a front wall receiving chamber 18.

As illustrated, in a non-limiting example, the ram 16 couples to the housing 12 at the back plane 32 of the baling chamber 20. It is contemplated that at least one wall 22, 24, 26, 28, 30 or 32 of the baling chamber 20 couples to the ram 16. It is further contemplated that the ram 16 can couple to the baling chamber 20 at one or more of the walls or planes 22, 24, 26, 28, 30 or 32.

As illustrated, in a non-limiting example, the ram 16 can include a hopper 34 for receiving material to be baled. Additionally or alternatively, material to be baled can be loaded directly into the baling chamber 20. Additionally or alternatively, by way of non-limiting example, material to be baled can be loaded into the hopper 34 via a conveyor system.

The ram 16 can include a ram wall 36 coupled to a ram wall driving mechanism 38. The ram wall driving mechanism 38 can be, but is not limited to, a hydraulic cylinder that can move the ram wall 36 from a first position 40 to a second position 42 to compress material to be baled into the baling chamber 20. By way of non-limiting example, when moving the ram wall 36 from the first position 40 to the second position 42, the ram wall 36 can move past the second position 42 toward the front wall 22 of the baling chamber 20 before returning to the second position 42. The ram wall 36 can move several times back and forth to various positions between the first position 40 and the front wall 22 before finishing a cycle in the second position 42, where the material to be baled is compressed within the baling chamber 20 between the ram 16 and the front wall 22. The first position 40 and second position 42 are shown by way of non-limiting example in the illustration and can be contemplated at other locations relative to the ram 16. One or more sensors can be used to ensure the ram 16 is properly located in the first or second position 40, 42. By way of non-limiting example, the one or more sensors can be an optical sensor, a photoelectric sensor, an ultrasonic sensor, a pressure sensor, a gps, or a field sensor.

A back wire slot 90 can be included in the ram wall 36. The back wire slot 90 can be, by way of non-limiting example, in the shape of a slot that can allow a bale tie to exit through-holes 62 (FIG. 5) of the ram wall 36 and enter the baling chamber 20.

It is also contemplated that the baling apparatus 10 includes an adjustable ram guide. The adjustable ram guide can include adjustable hold-down bars 44 and an adjustable frame shear 46. The adjustable hold-down bars 44 can be loosened by bolts 48. Once the adjustable hold-down bars 44 are adjusted to a new position, the bolts 48 can be tightened to maintain the adjusted position. Similarly, the adjustable frame shear 46 includes bolts (not shown) that can be loosened allowing for the adjustment of the position of the adjustable frame shear 46. Optionally, the adjusted position of the adjustable hold-down bars 44 or the adjustable frame shear 46 can be further supported by the addition of shims.

Figure 2:
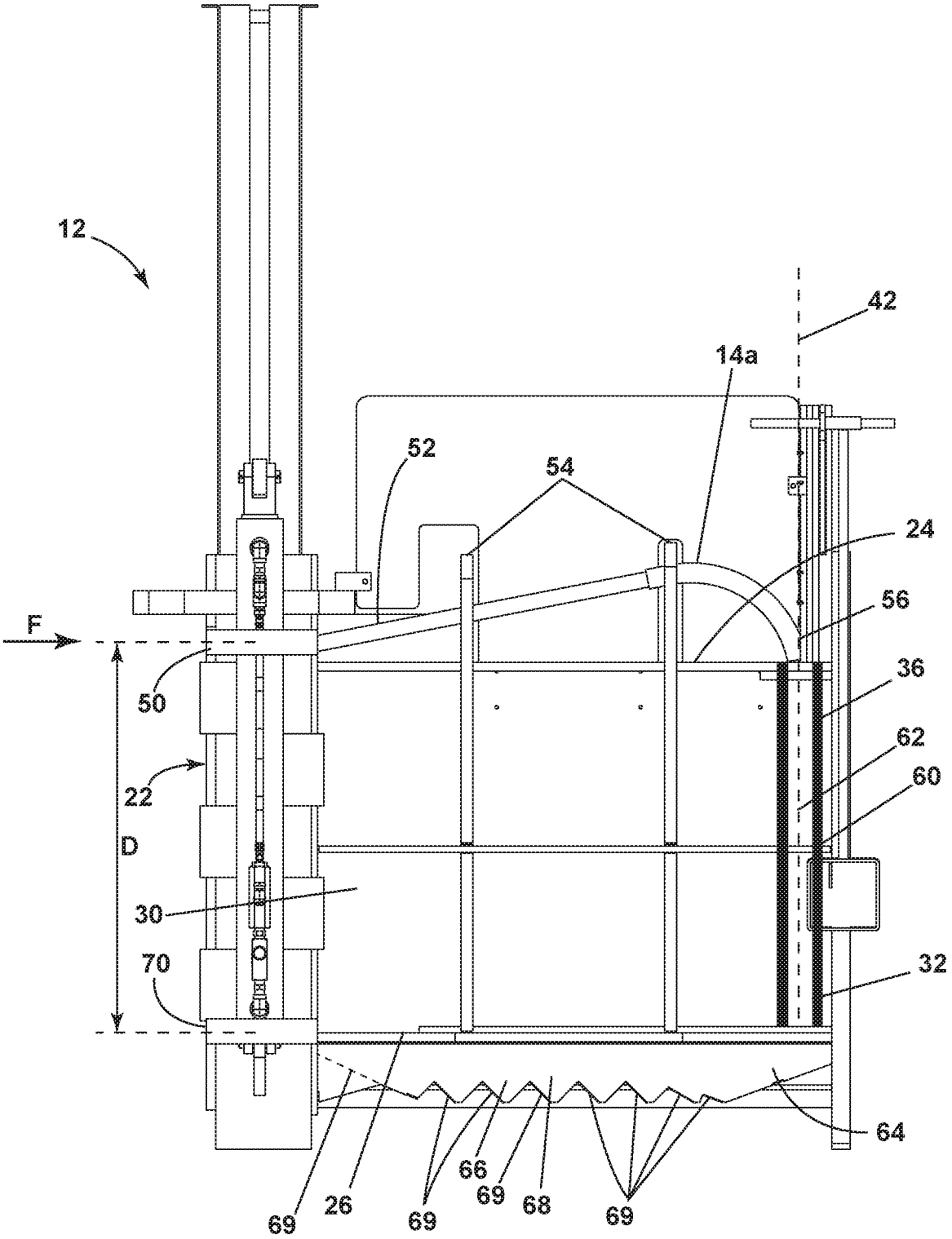
FIG. 2 is a schematic cross section of a portion of the baling apparatus of FIG. 1.

FIG. 2 is a schematic cross section of the housing 12 of the baling apparatus 10 when the ram wall 36 is in the second position 42, where material to be baled is compressed within the baling chamber 20. A baling guide 14*a* is representative of the set of baling guides 14. It is contemplated that each baling guide in the set of the baling guides 14 is similar to the baling guide 14*a*. The baling guide 14*a* includes an entrance 50, a top portion 52, a first corner 56, a back portion 60, a second corner 64, a bottom portion 66, and an exit 70.

The entrance 50 for receiving a bale tie is illustrated, by a non-limiting example, as an opening in the front wall 22 of the baling chamber 20. The bale tie is fed into the entrance 50 with an entrance force F. The entrance 50 can couple to a top portion 52 of the baling guide 14*a*. As illustrated by non-limiting example, the top portion 52 of the baling guide 14*a* can be a tube or conduit. Optionally, the tube or conduit can include one or more gaps, grooves, or openings. Additionally or alternatively, the top portion 52 of the baling guide 14*a* can be a groove or angled surface used to guide the bale tie.

The top portion 52 can be supported by at least a portion of the top wall 24 of the baling chamber 20 by top mounts 54.

The first corner 56 connects the top portion 52 of the baling guide 14*a* to the back portion 60. The back portion 60 of the baling guide 14*a*, by way of non-limiting example, is illustrated as through-holes 62 in the ram wall 36 that can receive the bale tie.

A second corner 64 can couple the back portion 60 of the baling guide 14*a* to the bottom portion 66 of the baling guide 14*a*. The second corner 64 can include at least part of a wire guide 68. The wire guide 68 can be located below the bottom wall 26 of the baling chamber 20 and define the bottom portion 66 of the baling guide 14*a*. The wire guide 68 can include one or more gaps, grooves, or openings. The wire guide 68 of the bottom portion 66 of the baling guide 14*a* includes a series of angled surfaces 69 that guide a bale tie to the exit 70 on the front wall 22. The exit 70 is illustrated as spaced a distance D from the entrance 50. The distance D can be any non-zero measurement of distance.

It is contemplated that any combination of tubing, conduit, connecting portions, curved or straight portions, angled portions, spacing, grooves, or other known means of guiding the bale tie can be used in addition to or as an alternative to any portion of the detailed non-limiting example of the baling guide 14*a*.

Figure 3:
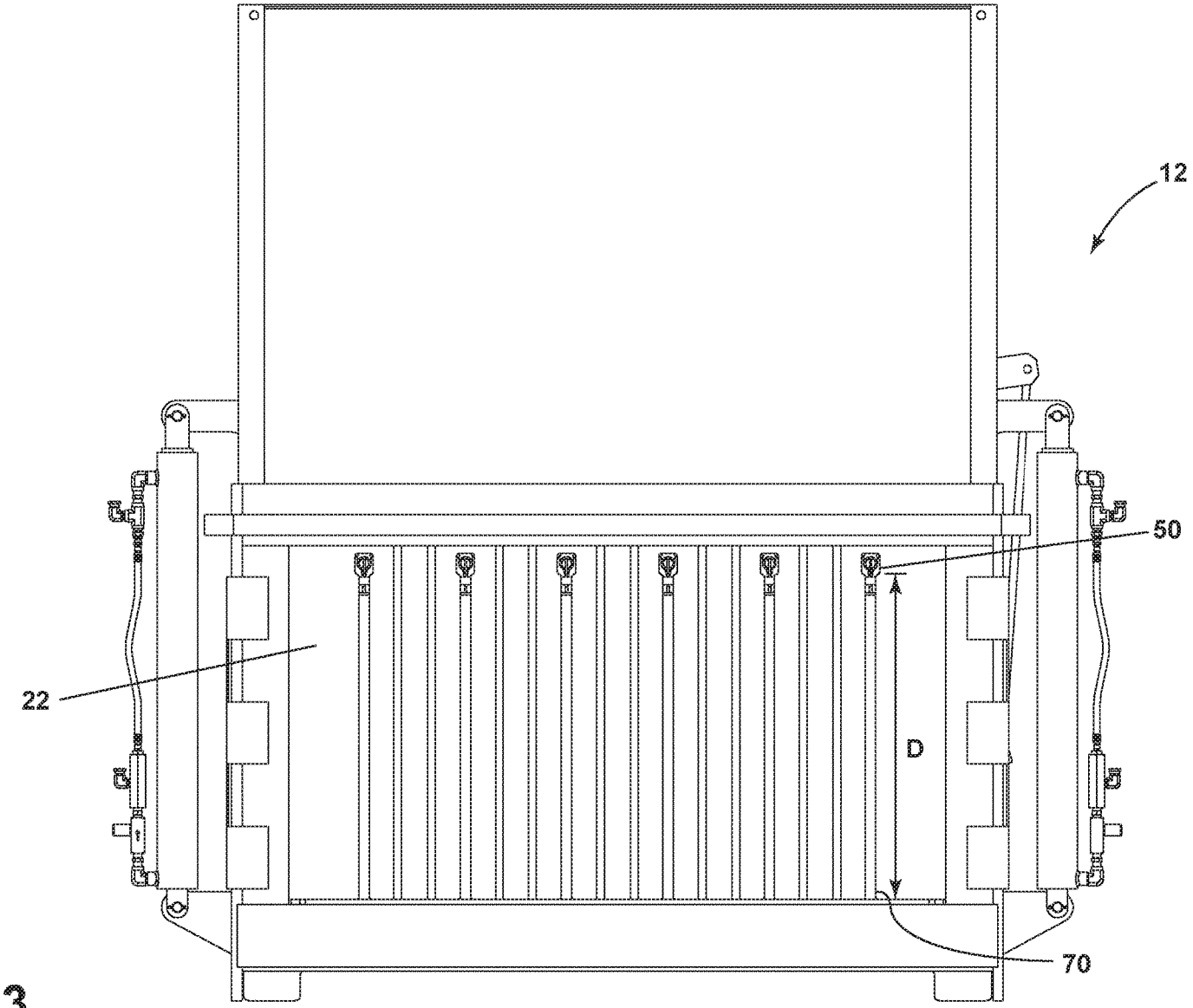
FIG. 3 is a front view of a housing of the baling apparatus of FIG. 1.

FIG. 3 is a front perspective view of the housing 12 of the baling apparatus 10. FIG. 3 further illustrates the exit 70 spaced the distance D from the entrance 50 on the front wall 22. It is contemplated that the entrance 50 and the exit 70 that is a distance D from the entrance 50, can be on any one wall 22, 24, 26, 28, 30, or 32 of the baling chamber 20, provided that the entrance 50 and the exit 70 are on the same wall.

Figure 4:
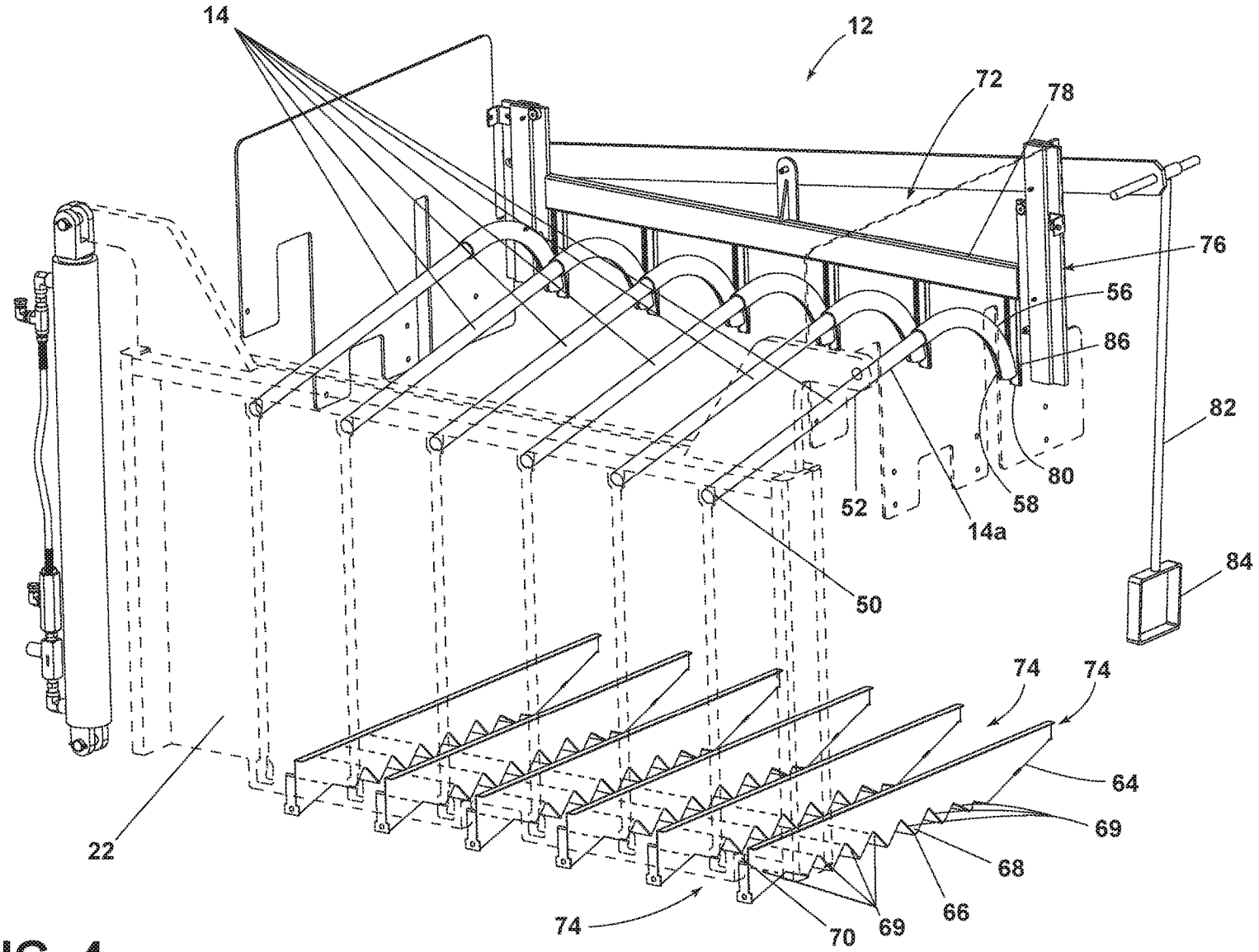
FIG. 4 is an isometric view of a portion of a baling guide from the baling apparatus of FIG. 1.

FIG. 4 is a perspective view of the housing 12 with the top wall 24, bottom wall 26, and opposing sidewalls 28, 30 removed. The ram wall 36 is in the first position 40 and is therefore not illustrated in this image.

A top wire slot 58 can be included in the top portion 52 of the baling guide 14*a*. The top wire slot 58 can have dimensions such that the bale tie cannot pass through the top wire slot 58 until the bale tie is guided through the top portion 52 of the baling guide 14*a*. The top wire slot 58 can correspond to the top wire inlet 25 (FIG. 1) such that when the bale tie exits the top portion 52, it can enter the baling chamber 20 via the top wire inlet 25 (FIG. 1).

The baling apparatus 10 can include a cleaning system 72. The cleaning system 72 can include a compressed air flow 74 or a piercer 76, or both.

The compressed air flow 74 can be provided by a pneumatic source (not shown) and is illustrated by non-limiting examples in FIG. 4 as arrows that indicate a possible direction for the flow of compressed air. It is contemplated that the compressed air flow 74 can be used to clean or clear one or more portions of the set of baling guides 14.

The piercer 76 can include a support beam 78, at least one tine 80, and an actuating mechanism 82. The support beam 78 couples to at least one tine 80 and an actuating mechanism 82. As illustrated, by way of non-limiting example, the actuating mechanism 82 can be activated by a foot pedal 84. Further it is contemplated that the actuating mechanism 82 can be, by way of non-limiting example, activated by a controller based on input from a sensor.

The at least one tine 80 is illustrated, by way of non-limiting example, to have a channel portion 86. The channel portion 86 can be a component of the first corner 56 to assist in the transition from the top portion 52 of the baling guide 14*a* to the back portion 60. It is also contemplated that the at least one tine 80, when activated, pierces the through-holes 62 of the ram wall 36 that define the back portion 60 of the baling guide 14*a*. It is further contemplated that the piercer 76 can be configured to clean or clear one or more portions of the set of bale guides 14.

Figure 5:
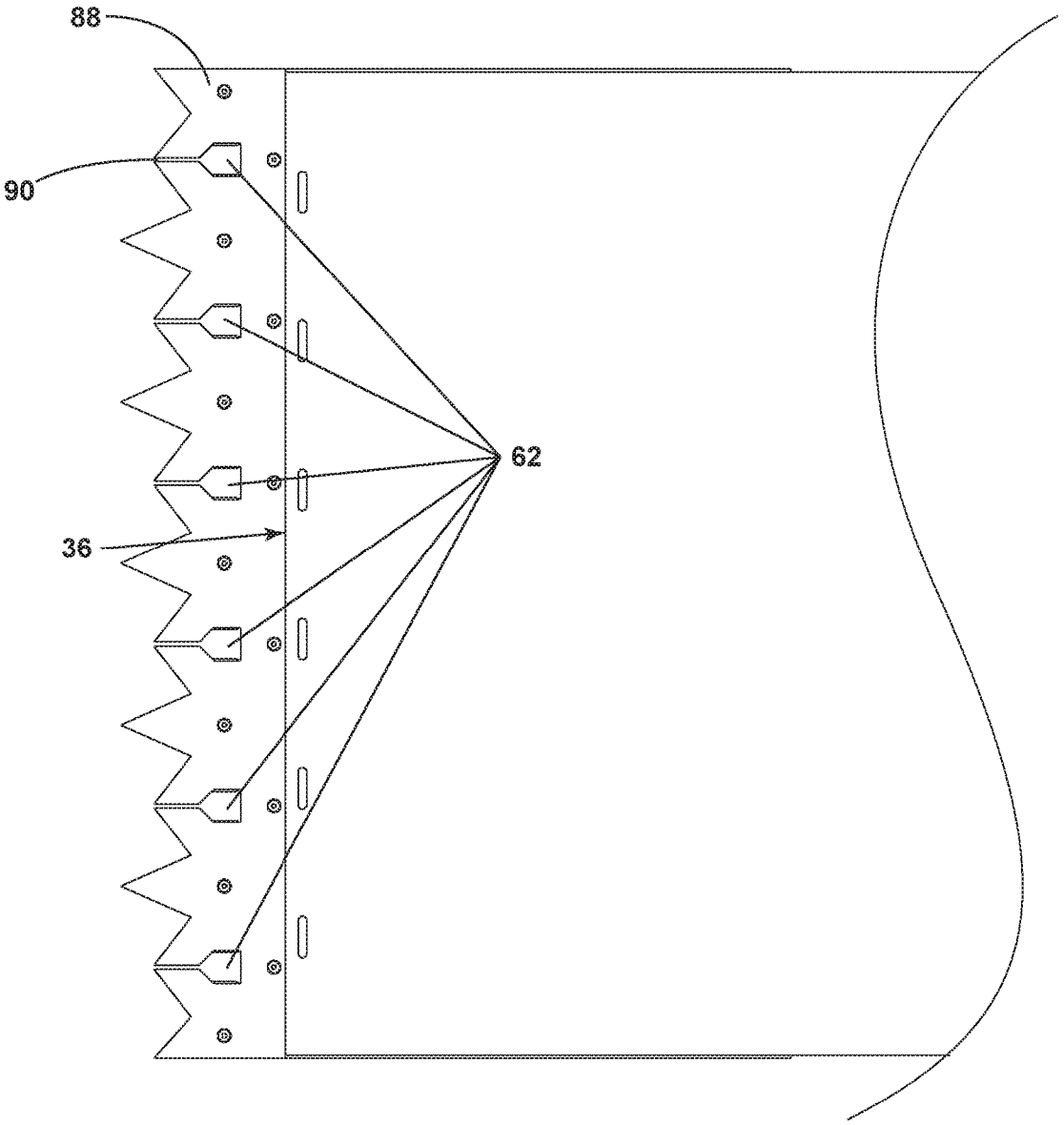
FIG. 5 is a top down view of a portion of a ram from the baling assembly of FIG. 1.

FIG. 5 illustrates a top view of the ram wall 36. The ram wall 36 can include a spiked plate 88. When the ram wall 36 is in the second position 42, the spiked plate 88 is flush beneath the adjustable frame shear 46 (FIG. 1). The spiked plate 88 can clear material to ensure the registry of the top portion 52, the first corner 56, and the through-holes 62 that can define, by way of non-limiting example, the back portion 60 of the baling guide 14*a*.

The back wire slot 90 allows the bale tie to enter the baling chamber 20 after being threaded through the back portion 60 of the baling guide 14*a*. The back wire slot 90, by way of non-limiting example, can have a slot dimension such that the bale tie can only leave the through-hole 62 of the back portion 60 once a clasping portion of bale tie has been threaded through the through-holes 62 of the ram wall 36.

Figure 6:
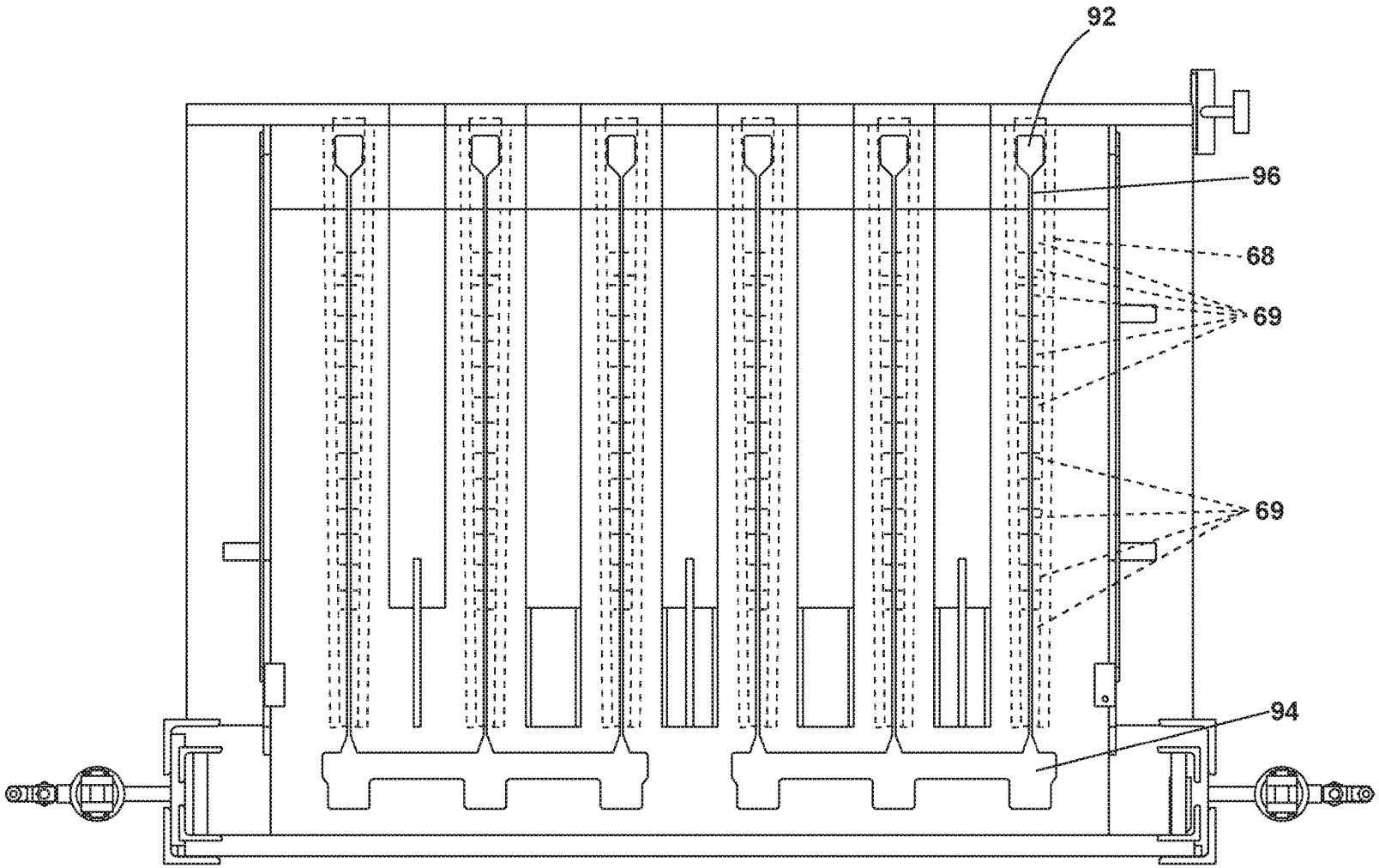
FIG. 6 is a top plan view of a bottom wall of the housing from the baling assembly of FIG. 1.

FIG. 6 is a top down view of a bottom wall 26 of baling chamber 20 formed in the housing 12. The wire guide 68 with angled surfaces 69 can be located below the bottom wall 26 of the baling chamber 20 and is illustrated using dotted lines. The bottom wall 26 can include a first hole 92 in which the bale tie can pass from the through-holes 62 of the back portion 60 to the wire guide 68 of the bottom portion 66 of the baling guide 14*a*. Once below the bottom wall 26, the angled surfaces 69 of the wire guide 68 guide form the second corner 64 and further guide the bale tie to a second hole 94 in the bottom wall 26. The bale tie exits the second hole 94 of the bottom wall 26 at such an angle that it continues to the exit 70 of the front wall 22.

A bottom wire slot 96 allows the bale tie to enter the baling chamber 20 through the bottom wall 26 after the bale tie has been threaded through the bottom portion 66 of the baling guide 14*a*. The bottom wire slot 96, by way of non-limiting example, can have a slot dimension such that the bale tie can only leave the wire guide 68 and pass through the bottom wall 26 into the baling chamber 20 once a clasping portion of the bale tie has been threaded through the wire guide 68.

Figure 7:
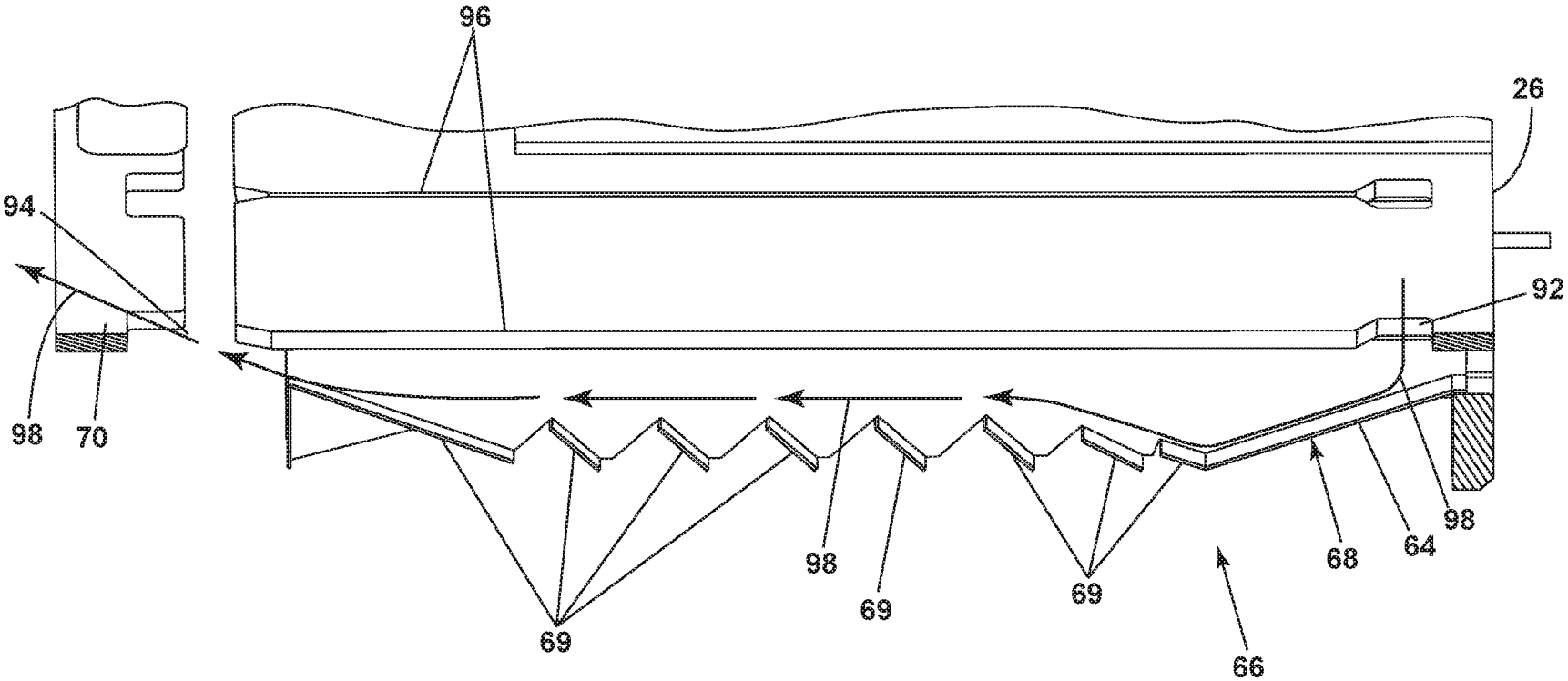
FIG. 7 is a partial cut away side view of the bottom wall from FIG. 6.

FIG. 7 is a partial cut away side view of the bottom wall 26 from FIG. 6 to further illustrate the bottom portion 66. Arrows 98, by non-limiting example, illustrate a possible bale tie path. The bale tie passes through the first hole 92 of the bottom wall 26 to the second corner 64. The second corner 64 can be a portion of the wire guide 68 that turns the bale tie into the bottom portion 66. The series of angled surfaces continues to guide the bale tie to the second hole 94 of the bottom wall 26. Once through the second hole 94 of the bottom wall 26, the bale tie exits the baling apparatus 10 through the exit 70.

Figure 8:
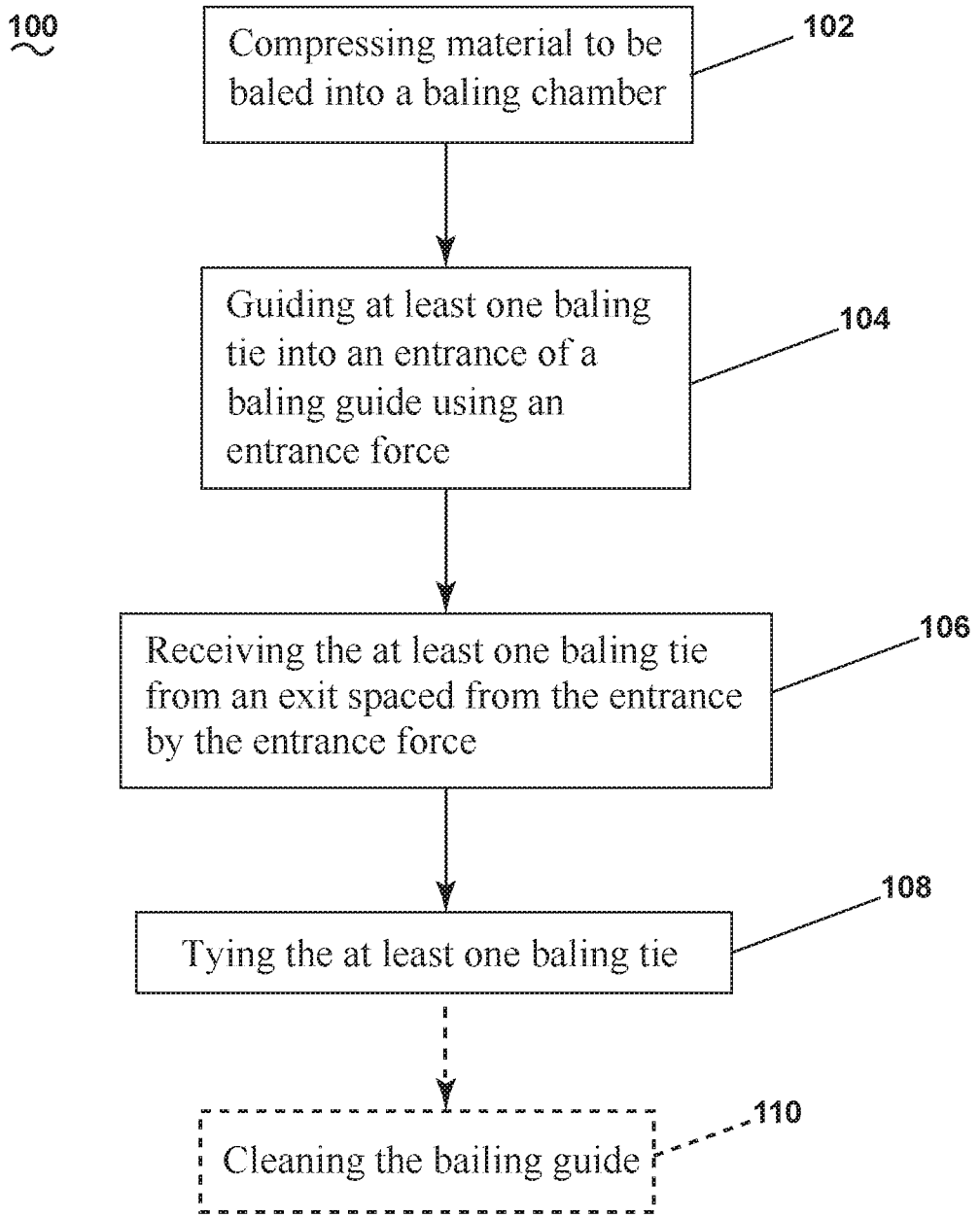
FIG. 8 is a flow chart showing a method of baling material from at least one wall of a baler according to aspects of the present disclosure.

FIG. 8 is a flow chart showing a method 100 of baling material from at least one wall of a baler. By way of a non-limiting example, the baler of method 100 can be, but is not limited to, operation of the baling apparatus 10.

Step 102 is compressing material to be baled into the baling chamber 20. At or prior to step 102, the ram wall 36 of the ram 16 is in a first position 40 and the front wall 22 is in a down or closed position. Material to be baled is loaded into the hopper 34 whereupon the ram wall driving mechanism 38 drives the ram wall 36 from the first position 40 to or past the second position 42. The motion of the ram wall 36 compresses the material to be baled into the baling chamber 20 through the back plane 32 of the housing 12. Step 102 may be repeated as necessary until the baling chamber 20 is full, and/or until material in the baling chamber 20 is deemed ready to be baled. The baling chamber 20 can be considered full or ready to bale using one or more sensors. By way of non-limiting example, one or more position sensors can indicate a location of the ram wall 36 and one or more pressure sensors located on the ram wall 36 or the ram wall driving mechanism 38. Once a predetermined pressure threshold for a predetermined ram wall 36 location is reached, the baling apparatus 10 can indicate the baling chamber 20 is full or ready to bale. The baling apparatus 10 can communicate the baling chamber 20 is full or ready to bale using any known user interface.

At step 104, at least one baling tie is guided into the entrance 50 of the baling guide 14*a* using the entrance force F. As illustrated in a non-limiting example by the baling apparatus 10, the entrance 50 is on the front wall 22 of the baling chamber 20. The baling tie is guided through the top portion 52, which can be in the shape of a tube. The baling tie transitions from the top portion 52 to the back portion 60 via the first corner 56. The first corner 56 can include a curved tube portion that opens to the channel portion 86 of the at least one tine 80 of the piercer 76. The channel portion 86 guides a leading end of the baling tie into the back portion 60 of the baling guide 14*a*. When in the second position 42, the ram wall 36 is aligned such that the through-holes 62 of the ram wall 36 define the back portion 60 of the baling guide 14*a*. Optionally, when the ram wall 36 reaches the second position 42, the at least one tine 80 can be actuated prior to the insertion of a bale tie so that at least a portion of the channel portion 86 of the at least one tine 80 penetrates at least a portion of the through-holes 62 of the ram wall 36.

After passing through the through-holes 62 of the ram wall 36, the leading end of the baling tie exits the ram wall 36 and passes through the first hole 92 in the bottom wall 26 to the wire guide 68. The second corner 64 guides the leading end of the baling tie from the back portion 60 to the bottom portion 66. The second corner 64 can optionally include one or more curved metal pieces of the wire guide 68. The wire guide 68 includes the series of angled surfaces 69 for guiding the baling tie towards the second hole 94 of the bottom wall 26. The bale tie passes through the second hole 94 an exits the exit 70 on the front wall 22. It is contemplated that one or more portions of the baling guide 14*a* can include gaps or openings.

At step 106 the leading end of the baling tie is received at the exit 70 on the front wall 22 by a user. The user can continue exerting entrance force F until the leading end of the baling tie is far enough past the exit 70 to meet a trailing portion of the baling tie. Alternatively or in addition, the use can pull the leading end of the baling tie until the leading end of the baling tie is far enough past the exit 70 to meet a trailing portion of the baling tie.

At step 108, the leading end of the baling is tie is secured as by tying, for example, to a trailing portion of the baling tie at the front wall 22 in a conventional manner. The baling tie exits the top portion 52 of the baling guide 14*a* through the top wire slot 58 that is aligned so that the bale tie enters the baling chamber 20 through the top wire inlet 25. The bale tie exits the back portion 60 of the baling guide 14*a* and passes into the baling chamber 20 through the back wire slot 90. The bale tie exits the bottom portion 66 of the baling guide 14*a* and passes into the baling chamber 20 through the bottom wire slot 96. Once tied at the front wall 22, the bale tie secures the material to be baled. Optionally, the bale tie can be twisted or tightened.

It will be understood that the baling guide 14*a* guides the baling tie so that the user only needs to apply the entrance force F to feed the baling tie through the baling guide 14*a*. Once the baling tie reaches the exit 70 on the same at least one wall of the baling apparatus 10 as the entrance 50, the user can tie the baling tie. It will be further understood that a user can apply the entrance force F to succeeding bailing ties in other baling guides 14*a* in the set, or apply entrance force F simultaneously to multiple bailing ties in other baling guides 14*a* in the set. In any event, as the entrance force F (as indicated by the arrow in FIG. 2), the baling tie will continue from the entrance 50, through the baling guide 14*a*, and out the exit 70. The exit 70 is on the same wall as the entrance 50, which in the current non-limiting example is the front wall 22.

Optionally, at 110 the method 100 can include cleaning a portion of the baling guide 14*a* using the cleaning system 72. The compressed air flow 74 can be used to clean at least a portion of the baling guide 14*a* prior to, during, or after any or all of the steps 102, 104, 106, or 108.

Additionally or alternatively at 110, the piercer 76 can be used to clean at least a portion of the baling guide 14*a* after any or all of the steps 102, 104, 106, or 108. It is further contemplated that the set of baling guides 14 can include more than one piercer for cleaning a portion of the set of baling guides 14.

A benefit of the present invention is that a user can feed a baling tie around material to be baled and then tie the baling tie without having to change locations during the baling process.

To the extent not already described, the different features and structures of the present disclosure can be used in combination with each other as desired. That one feature may not be illustrated in all the embodiments and is not meant to be construed that it cannot be, but is done for brevity of description. Thus, the various features of the different embodiments can be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A baling apparatus comprising:

a housing defining a baling chamber by at least one wall;

a ram comprising a ram wall parallel to the at least one wall, wherein the ram wall is configured to compress material to be baled into the baling chamber; and a set of baling guides adjacent to the baling chamber, wherein each baling guide in the set of baling guides includes an entrance at the at least one wall, a first corner, a back portion spaced from the at least one wall, a second corner, a bottom portion located below a bottom wall of the baling chamber, and an exit at the at least one wall spaced from the entrance, wherein the entrance and the exit extend through the at least one wall, and wherein a bale tie entering the baling guide through the at least one wall via the entrance with an entrance force, passes through the first corner, the back portion, the second corner, the bottom portion and the exit of the baling guide by the entrance force for tying at the at least one wall.

2. The baling apparatus of claim 1 wherein each baling guide includes at least one groove, tube, or contoured or angled surface.

3. The baling apparatus of claim 1 wherein each baling guide includes gaps or openings.

4. The baling apparatus of claim 1 wherein the back portion of each baling guide passes through the ram wall.

5. The baling apparatus of claim 1 wherein the bottom portion includes a wire guide comprising a series of angled surfaces.

6. The baling apparatus of claim 1, further comprising a cleaning system configured to clean at least a portion of each baling guide.

7. The baling apparatus of claim 6 wherein the cleaning system includes compressed air configured to clean the at least a portion of each baling guide.

8. The baling apparatus of claim 6 wherein the cleaning system includes a piercer configured to clean the at least a portion of each baling guide.

9. The baling apparatus of claim 8 wherein the piercer is coupled to a foot pedal.

10. The baling apparatus of claim 1 wherein the ram includes an adjustable ram guide.

11. The baling apparatus of claim 1 wherein the at least one wall is lifted into an open position and is received by a receiving chamber.

12. A method of baling material from a front wall of a baler, the method comprising:

compressing the material to be baled into a baling chamber of the baler;

guiding at least one baling tie through a baling guide using an entrance force at the front wall of the baler, wherein the baling guide includes an entrance that extends horizontally through the front wall, a first corner, a back portion, a second corner, and a bottom portion comprising a wire guide located below a bottom wall of the baling chamber;

receiving, by the entrance force, at least a portion of the at least one baling tie from an exit that extends horizontally through the front wall, spaced from the entrance at the front wall; and tying the at least one baling tie at the front wall.

13. The method of claim 12 wherein the guiding includes urging the at least one baling tie through at least one tube.

14. The method of claim 12 wherein the guiding includes alignment of a ram so that a portion of the baling guide passes through a ram wall.

15. The method of claim 12 wherein the wire guide comprises a series of angled surfaces.

16. The method of claim 12 wherein the guiding includes urging the at least one baling tie through gaps or openings in the baling guide.

17. The method of claim 12, further comprising cleaning the baling guide by a cleaning system.

18. The method of claim 17 wherein the cleaning system includes one or more of compressed air or a piercer.

19. A baling apparatus comprising:

a housing defining a baling chamber by at least one wall;

a ram comprising a ram wall parallel to the at least one wall, wherein the ram wall is configured to compress material to be baled into the baling chamber;

a set of baling guides adjacent to the baling chamber, each baling guide in the set of baling guides configured to receive a bale tie, wherein each baling guide in the set of baling guides includes an entrance that extends horizontally through the at least one wall, at least one corner, a wire guide located below a bottom wall of the baling chamber, and an exit that extends horizontally through the at least one wall, wherein the exit is spaced from the entrance; and wherein the bale tie entering the baling guide through the at least one wall via the entrance with an entrance force, passes through the at least one corner, the wire guide and the exit of the baling guide by the entrance force for tying at the at least one wall.

20. The baling apparatus of claim 19, wherein the at least one corner is a first and second corner.

* * * * *